US010734000B2

(12) United States Patent
Perechnev

(10) Patent No.: US 10,734,000 B2
(45) Date of Patent: Aug. 4, 2020

(54) METHOD AND APPARATUS FOR CONDITIONING AN AUDIO SIGNAL SUBJECTED TO LOSSY COMPRESSION

(71) Applicant: ASK INDUSTRIES GMBH, Niederwinkling (DE)

(72) Inventor: Denis Perechnev, Straubing (DE)

(73) Assignee: ASK INDUSTRIES GMBH, Niederwinkling (DE)

( * ) Notice: Subject to any disclaimer, the term of this patent is extended or adjusted under 35 U.S.C. 154(b) by 108 days.

(21) Appl. No.: 16/076,880

(22) PCT Filed: Mar. 13, 2017

(86) PCT No.: PCT/EP2017/055820
§ 371 (c)(1),
(2) Date: Aug. 9, 2018

(87) PCT Pub. No.: WO2017/157841
PCT Pub. Date: Sep. 21, 2017

(65) Prior Publication Data

US 2019/0080702 A1 Mar. 14, 2019

(51) Int. Cl.
*G10L 19/008* (2013.01)
*G10L 19/02* (2013.01)
(Continued)

(52) U.S. Cl.
CPC ..... *G10L 19/008* (2013.01); *G10L 19/0017* (2013.01); *G10L 19/012* (2013.01); *G10L 19/0208* (2013.01); *G10L 21/0364* (2013.01)

(58) Field of Classification Search
CPC . G10L 19/008; G10L 19/0017; G10L 19/012; G10L 19/0208; G10L 21/0364
See application file for complete search history.

(56) References Cited

U.S. PATENT DOCUMENTS 5,479,560 A 12/1995 Mekata
9,398,294 B2 * 7/2016 Robillard ..... G10L 19/008
(Continued)

FOREIGN PATENT DOCUMENTS

DE 10103134 A1 8/2002
EP 1501190 A1 1/2005
WO 2015010950 A1 1/2015

*Primary Examiner* — Mohammad K Islam
(74) *Attorney, Agent, or Firm* — Rimôn, P.C.

(57) ABSTRACT

The present invention relates to a method for conditioning an audio signal subjected to lossy compression involving the transfer of an audio signal to a frequency spectrum in which energies of the audio signal are correlated with frequencies of the audio signal, ascertainment of the frequencies $f_i$ of local amplitude maxima in the frequency spectrum, stipulation of a first selection criterion and preselection of the frequencies $f_i$ of two directly successive local amplitude maxima stipulation of a second selection criterion and selection of preselected frequencies $f_i$, of two directly successive local amplitude maxima, generation of an audio filler signal (AFS) and conditioning of the audio signal by introducing the audio filler signal (AFS) into a frequency range between the frequencies $f_i$, so that the frequency range is filled with the audio filler signal (AFS) at least in sections, in particular completely.

15 Claims, 5 Drawing Sheets

(51) Int. Cl.

| | |
|---|---|
| ***G10L 21/0364*** | (2013.01) |
| ***G10L 19/00*** | (2013.01) |
| ***G10L 19/012*** | (2013.01) |

(56) References Cited

U.S. PATENT DOCUMENTS

| | | | | |
|---|---|---|---|---|
| 2003/0233234 | A1 | 12/2003 | Truman et al. | |
| 2007/0016414 | A1 | 1/2007 | Mehrotra et al. | |
| 2013/0191118 | A1 | 7/2013 | Makino | |
| 2013/0226597 | A1* | 8/2013 | Kjoerling | G10L 19/26 704/500 |
| 2014/0029752 | A1* | 1/2014 | Kishi | G10L 19/008 381/22 |
| 2015/0332686 | A1 | 11/2015 | Disch et al. | |
| 2016/0005407 | A1* | 1/2016 | Friedrich | G10L 19/167 381/22 |
| 2016/0140974 | A1* | 5/2016 | Valero | G10L 19/008 381/22 |
| 2017/0133020 | A1* | 5/2017 | Kordon | H04S 7/30 |
| 2017/0134874 | A1* | 5/2017 | Kordon | G10L 19/008 |
| 2017/0154633 | A1* | 6/2017 | Krueger | G10L 19/20 |

* cited by examiner

METHOD AND APPARATUS FOR CONDITIONING AN AUDIO SIGNAL SUBJECTED TO LOSSY COMPRESSION

CROSS-REFERENCE TO RELATED APPLICATIONS

This application is a United States national stage entry of an International Application serial no. PCT/EP2017/055820 filed Mar. 13, 2017, which claims priority to German Patent Application serial no. 10 2016 104 665.5 filed Mar. 14, 2016. The contents of these applications are incorporated herein by reference in their entirety as if set forth verbatim.

The invention relates to a method for conditioning an audio signal subjected to lossy compression.

The data compression of audio signals and audio information, such as e.g. music files, is known per se. The purpose of the data compression is to reduce the data volume of corresponding audio signals. The data compression can essentially be carried out in a lossy or lossless manner. Lossy data compression, in particular, which can be implemented, for example, through data-related discarding of frequency components located at the periphery of the human hearing range will be considered below. Subjective audio perception by a listener should thus be hardly affected.

Due to the comparatively reduced sound quality of audio signals subjected to lossy compression, it is sometimes desirable to condition audio signals subjected to lossy compression, i.e. to restore correspondingly discarded frequency components or replace them at least partially with comparable frequency components.

Different technical approaches for conditioning audio signals subjected to lossy compression are currently known. The design of these known approaches is normally comparatively complex (in terms of processing) and inefficient. A need therefore exists to develop improved methods for conditioning an audio signal subjected to lossy compression.

The object of the invention is therefore to indicate an improved method for conditioning an audio signal subjected to lossy compression.

The object is achieved by a method as claimed in claim 1. The associated dependent claims relate to advantageous embodiments of the method. The object is furthermore achieved by the apparatus as claimed in claim 14 and by the audio device as claimed in claim 15.

The method described herein generally serves to condition an audio signal subjected to lossy compression. An audio signal to be conditioned or conditioned according to the method may be e.g. an audio file subjected to lossy compression are a part of such a file. It may specifically be e.g. an audio file subjected to lossy compression by means of an MP3 algorithm, i.e. an MP3-coded audio file or MP3 file.

The audio file or parts thereof may already be decoded. Suitable decoding algorithms, for example, via which an at least partial decoding of the MP3-coded audio file has been performed can therefore be used for the aforementioned example of an MP3-coded audio file. The same obviously applies accordingly to audio data which have not been coded via an MP3 algorithm, but via different algorithms.

In all cases, the audio file can contain e.g. audio signals e.g. of a piece of music.

A conditioning is essentially understood to mean an at least partial restoration of missing frequency components, i.e., for example, frequency components discarded during the data compression, or an at least partial replacement of missing frequency components, i.e., for example, frequency components discarded during the data compression, with comparable frequency components. As indicated below, an at least partial replacement of missing frequency components, i.e., for example, frequency components discarded during the data compression, is relevant in particular for the conditioning according to the method of audio signals subjected to lossy compression.

The individual steps of the method described herein are explained in detail below:

In a first step of the method, an audio signal subjected to lossy compression which is to be conditioned is provided. A corresponding audio signal can essentially be provided via any physical or non-physical audio source, i.e., for example, from an audio device for processing and outputting audio signals.

In a second step of the method, the audio signal is transferred into a frequency spectrum. Energies of the audio signal are correlated with frequencies of the audio signal in the frequency spectrum. In other words, the content of the audio signal is examined for its energy components, i.e. amplitude components and frequency components, and the individual energy components of the audio signal are transferred or converted in respect of their data into a frequency-dependent representation. To do this, the audio signal is typically subdivided into individual, if necessary overlapping, time intervals which are transferred or converted individually into the frequency spectrum. The audio signal is transferred or converted into the frequency spectrum by means of suitable algorithms, i.e., for example, by means of (fast) Fourier transform algorithms. The length of the algorithms is essentially variable. The examination of the content of the audio signal for its energy components may entail a classification and grouping of the energy components and an estimation of the energy components of the audio signal.

In a third step of the method, frequencies of local amplitude maxima are determined in the frequency spectrum. In other words, the frequency spectrum is examined for local amplitude maxima and the frequencies associated with the respective amplitude maxima are determined. A local amplitude maximum is understood to mean an amplitude maximum value in a defined frequency environment range. Local amplitude maxima are determined by means of suitable analysis algorithms.

In a fourth step of the method, a first selection criterion is specified. The frequencies of two immediately successive (local) amplitude maxima are preselected on the basis of the first selection criterion, said frequencies meeting the first selection criterion. In the fourth step, the frequencies of pairs of immediately successive amplitude maxima are therefore examined in respect of the first selection criterion. In the fourth step, a pair-by-pair examination of the frequencies of immediately successive amplitude maxima is therefore carried out in order to ascertain whether the frequencies associated with the respective amplitude maxima meet the first selection criterion. In the further steps of the method, only the frequencies meeting the first selection criterion are typically considered. The frequencies or the associated amplitude maxima to be considered below are therefore preselected in the fourth step.

The first selection criterion typically describes a specific limit frequency value (range) (threshold). Frequencies of immediately successive amplitude maxima meet the first selection criterion if the amount of their frequency difference exceeds the limit frequency value (range) described by the first selection criterion, cf. the relationship represented by the formula I set out below:

$$\Delta f_i > |\Delta f_T| (I),$$

where $\Delta f_i$ is the frequency difference between two immediately successive amplitude maxima and $\Delta f_T$ is the limit frequency value (range).

The limit frequency value (range) can be specified by transferring the preselected frequencies into a Bark scale. As is known, frequencies can essentially be transferred into a Bark scale. The preselected frequencies are transferred into a Bark scale on the basis of the relationship represented by the following formula II:

$$z = 13 \cdot \arctan(0.00076 \cdot f) + 3.5 \cdot \arctan\left(\frac{f}{7500}\right)^2, \quad \text{(II)}$$

where z is a Bark value and f is the frequency value to be transferred into the Bark scale.

Preselected frequencies and also the limit frequency value described by the first selection criterion can be transferred into the Bark scale via the relationship represented by formula II.

The limit frequency value can essentially correspond to a Bark value or a Bark value adjusted via an adjustment factor or multiplied by an adjustment factor. The adjustment factor is typically between 0.7 and 1.1, in particular 0.9 Bark. The limit frequency value thus typically corresponds to 0.7 to 1.1, in particular 0.9 Bark. In other words, the frequency difference between the respective frequencies should correspond to a Bark value or approximately a Bark value in order to meet the first selection criterion. A certain variability of the limit frequency value is provided by the adjustment factor.

A second selection criterion is specified in a fifth step of the method. Preselected frequencies of two immediately successive local amplitude maxima which meet the second selection criterion are selected on the basis of the second selection criterion which are preselected (on the basis of the first selection criterion). In the fifth step, preselected frequencies are considered in relation to the second selection criterion. In the fifth step, preselected frequencies are thus examined to determine whether they (additionally) meet the second selection criterion.

The second selection criterion may describe a limit energy value (range). Respective preselected frequencies meet the second criterion if the amount of the energy content between them falls below this limit energy value (range) (threshold) described by the second selection criterion.

The limit energy value (range) may be defined by a specified limit energy content. Respective preselected frequencies meet the second selection criterion if their amount falls below the limit energy content described by the second selection criterion, cf. the relationship represented by formula III set out below:

$$\int_{f1}^{f2} |S(f)|^2 \, df < T, \quad \text{(III)}$$

where S(f) is the area (energy content between the frequencies or frequency values $f_1$, $f_2$ of the two immediately successive amplitude maxima) described by the frequencies or frequency values $f_1$, $f_2$ of the two immediately successive amplitude maxima), and T is the limit energy content.

The limit energy value (range) can alternatively also be determined by producing a first energy characteristic originating from the preselected frequency ("lower frequency") which is associated with the lower (lower-frequency) amplitude maximum and a second energy characteristic originating from the frequency ("upper frequency") which is associated with the immediately following upper (higher-frequency) amplitude maximum, and the two energy characteristics are transferred into the frequency spectrum. The limit energy value is then defined by the respective energy characteristics. The first energy characteristic passes originally from the frequency of the lower (lower-frequency) amplitude maximum of the two immediately successive amplitude maxima in the direction of the frequency of the upper-frequency (higher) amplitude maximum of the two immediately successive amplitude maxima. The second energy characteristic passes originally from the frequency of the upper (upper-frequency) amplitude maximum of the two immediately successive amplitude maxima in the direction of the frequency of the lower (lower-frequency) amplitude maximum of the two immediately successive amplitude maxima. The energy characteristics produced can be transferred in respect of their data into the frequency spectrum. An enclosed range or an enclosed area is defined by the actual frequency characteristic between the frequencies and the energy characteristics. The range is defined in terms of frequency components by the frequencies of the two immediately adjacent amplitude maxima and in terms of energy components by the actual frequency characteristic between the amplitude maxima and the energy characteristics passing between them. The range typically contains only energy values zero. If the range is considered geometrically in relation to the frequency spectrum, the range corresponds to the area geometrically defined by the two immediately adjacent amplitude maxima, the energy characteristics and frequency characteristics passing between said amplitude maxima and the frequency axis (x-axis).

The energy characteristics are typically generated on the basis of a psychoacoustic model. A psychoacoustic model is therefore typically used or the energy characteristics are derived from a psychoacoustic model in order to produce the energy characteristics. The psychoacoustic model generally describes those frequency components of a specific noise which are perceivable by the human ear in a specific noise environment, i.e. possibly in the presence of other noises. A preferentially used psychoacoustic model is the spectral occlusion or masking model which describes that human hearing is not capable of perceiving specific frequency components of a specific noise or is able to perceive them with reduced sensitivity only. These occlusion or masking effects are essentially based on the anatomical or mechanical characteristics of the human inner ear, as a result of which, for example, low-energy or quiet sounds in the medium frequency range are not perceivable with simultaneous reproduction of energy-rich or loud sounds in the low frequency range; the sounds in the low frequency range mask the sounds in the medium frequency range.

The energy characteristics are derived, in particular, from the hearing thresholds of human hearing defined by the respective psychoacoustic model at respective preselected frequencies. This means that the psychoacoustic model is applied in each case to the frequencies of the two immediately successive amplitude maxima.

The first energy characteristic corresponds to the part of the hearing threshold derived from the psychoacoustic model for the frequency of the lower amplitude maximum, said part extending in the direction of increasing frequencies. The second energy characteristic corresponds to the part of the hearing threshold derived from the psychoacoustic model for the frequency of the upper amplitude maximum, said part extending in the direction of decreasing frequencies.

It is fundamental to the method that frequency ranges between the respective frequencies of two immediately successive amplitude maxima are conditioned, said frequencies meeting both the first and the second selection criterion. The steps of the method described thus far therefore relate to the determination of frequency ranges to be conditioned within the audio signal to be conditioned.

In a sixth step of the method, an audio filler signal is produced or generated. The audio filler signal is typically produced in a targeted manner in relation to the previously determined frequency ranges to be conditioned within the audio signal to be conditioned. The audio filler signal is therefore typically produced in a targeted manner in relation to the frequency range defined by immediately successive frequencies which meet both the first and the second selection criterion in order to fill said frequency range and to fill the "energy valley" present between the frequencies at least in sections, in particular completely. The produced audio filler signal therefore appropriately has a frequency range lying between the frequencies of respective immediately successive amplitude maxima. The audio filler signal is produced e.g. by means of a suitable signal generator.

In a seventh step of the method, the actual conditioning of the audio signal is carried out by bringing the audio filler signal into respective frequency ranges between respective frequencies meeting the first and second selection criterion so that a respective frequency range is filled at least in sections, in particular completely, with the audio filler signal.

In other words, corresponding "energy valleys" resulting from the data compression of the audio signal are determined according to the method and are filled in a targeted manner with a specific data content in the form of the audio filler signal produced with regard to the determined "energy valleys", whereby a conditioning of the audio signal is implemented. As a result, the conditioning of the audio signal according to the method, as mentioned above, is implemented, in particular, by an at least partial replacement of missing frequency components of the audio signal, i.e., for example, frequency components discarded during the data compression.

A method for conditioning an audio signal subjected to lossy compression is provided by the described steps of the method, said method being improved particularly in terms of the efficiency of the conditioning and the quality of the conditioned audio signal.

It is obviously possible in an optional eighth step of the method to output the correspondingly conditioned audio signal via at least one signal output device, e.g. configured as a loudspeaker device or comprising at least one such device. An optional eighth step of the method can therefore provide an output of a conditioned audio signal via at least one signal output device. Alternatively or additionally, it is possible in the eighth step of the method to (temporarily) store the correspondingly conditioned audio signal in a storage device, i.e., for example, a hard disk storage device. A correspondingly conditioned stored audio signal can be output at a later time via at least one corresponding signal output device and/or can be transmitted via a suitable, in particular wireless, communication network to at least one communication partner. An optional eighth step of the method can therefore (also) provide a storage of a conditioned audio signal in at least one storage device and/or a transmission of a conditioned audio signal to at least one communication partner. The conditioned audio signal can be subjected to an inverse Fourier transform before the output and/or storage and/or transmission.

It is possible for a, where relevant, third energy characteristic originating from the selected frequency ("lower frequency") which is associated with the lower (lower-frequency) amplitude maximum, and a, where relevant fourth energy characteristic originating from the selected frequency ("upper frequency") which is associated with the (higher-frequency) amplitude maximum to be produced before the conditioning of the audio signal by bringing the audio filler signal into the frequency range between the frequencies meeting the second selection criterion, and for these two energy characteristics to be transferred into the frequency spectrum. The, where relevant, third energy characteristic passes originally from the frequency of the lower (lower-frequency) amplitude maximum of the two immediately successive amplitude maxima in the direction of the frequency of the upper (upper-frequency) amplitude maximum of the two immediately successive amplitude maxima. The, where relevant, fourth energy characteristic passes originally from the frequency of the upper (higher-frequency) amplitude maximum of the two immediately successive amplitude maxima in the direction of the frequency of the lower (lower-frequency) amplitude maximum of the two immediately successive amplitude maxima. The energy characteristics produced can in turn be transferred in respect of their data into the frequency spectrum. An enclosed range or an enclosed area is similarly defined by the frequencies and the energy characteristics. The range is again defined in terms of frequency components by the frequencies of the two immediately successive amplitude maxima and in terms of energy by the energy characteristics passing between them. The range typically contains only energy values zero. If the range is considered geometrically in relation to the frequency spectrum, the range again corresponds to the area geometrically defined by the two immediately adjacent amplitude maxima, the energy characteristics and frequency characteristics passing between them and the frequency axis (x-axis).

Similarly, the, where relevant, third and fourth energy characteristics are typically generated on the basis of a psychoacoustic model. Similarly, a psychoacoustic model is therefore typically used or the energy characteristics are derived from a psychoacoustic model in order to produce the energy characteristics. The descriptions relating to the first two energy characteristics apply accordingly.

The, where relevant, third and fourth energy characteristics are similarly derived, in particular, from the hearing thresholds of human hearing defined by the respective psychoacoustic model at respective preselected frequencies. This means that the psychoacoustic model is applied in each case to the frequencies of the two immediately successive amplitude maxima. The, where relevant, third energy characteristic corresponds to the part of the hearing threshold derived from the psychoacoustic model for the frequency of the lower amplitude maximum, said part extending in the direction of increasing frequencies. The, where relevant, fourth energy characteristic corresponds to the part of the hearing threshold derived from the psychoacoustic model for the frequency of the upper amplitude maximum, said part extending in the direction of decreasing frequencies.

If, as explained above, also in connection with the limit energy value described by the second selection criterion, corresponding energy characteristics are intended to be produced and transferred into the frequency spectrum, these (first two) energy characteristics may differ from the (third and fourth) energy characteristics mentioned in the previous paragraph.

The audio filler signal is furthermore brought, at least in sections, in particular completely, into the range of the frequency spectrum defined by the two preselected frequencies and the respective energy characteristics. The audio signal is therefore conditioned here by bringing the audio filler signal into the frequency range of the frequency spectrum defined by the frequencies of the two immediately adjacent amplitude maxima and the respective energy characteristics so that the range of the frequency spectrum defined by the frequencies of the two immediately successive amplitude maxima and the respective energy characteristics is or becomes filled at least in sections, in particular completely, with the audio filler signal.

In all cases, the audio filler signal can be produced depending on or independently from acoustic parameters of the audio signal to be conditioned, in particular relating to respective energy and frequency components of the audio signal. However, the audio filler signal is appropriately produced independently from acoustic parameters of the audio signal, i.e. purely in terms of the filling, at least in sections, of the range of the frequency spectrum defined by the frequencies of the two immediately adjacent amplitude maxima, since the computational complexity for producing the audio filler signal can, where relevant, thus be substantially reduced.

If the audio filler signal is produced depending on acoustic parameters of the audio signal, the range of the frequency spectrum defined by the frequencies of the two immediately successive amplitude maxima can be totally or partially filled depending on specific acoustic parameters of the audio signal, in particular the amplitude characteristic and/or frequency characteristic, or specific acoustic parameters of a further audio signal to be conditioned, in particular of the amplitude characteristic and/or frequency characteristic. A perception of the conditioned audio signal that is possibly more natural to the human ear can thus be implemented.

A Bark scale can essentially be used as a frequency spectrum into which the audio signal is transferred according to the method. As is known, the 24 individual Barks or bands of the Bark scale correspond to the 24 individual frequency groups of the human ear, i.e. those frequency ranges which are jointly evaluated by the human ear. The individual Barks or bands of the Bark scale contain different frequencies or frequency ranges or bandwidths. Possible frequency bands of the frequency spectrum may correspond to the 24 Barks or bands of the Bark scale.

Along with the described method, the invention furthermore relates to an apparatus for conditioning an audio signal subjected to lossy compression according to the method as described above. The apparatus comprises at least one control device implemented in the form of hardware and/or software which is characterized in that it is configured for

- transferring an audio signal into a frequency spectrum in which energies of the audio signal can be correlated with frequencies of the audio signal,
- determining frequencies of local amplitude maxima in the frequency spectrum,
- specifying a first selection criterion and preselecting the frequencies of two immediately successive local amplitude maxima, said frequencies meeting the first selection criterion,
- specifying a second selection criterion and selecting preselected frequencies, meeting the first selection criterion, of two immediately successive amplitude maxima, said frequencies additionally meeting the second selection criterion,
- producing an audio filler signal, and
- conditioning the audio signal by bringing the audio filler signal into a range between the frequencies meeting the second selection criterion, so that the range is filled at least in sections, in particular completely, with the audio filler signal.

Obviously, individual, a plurality or all of the steps carried out according to the method can also be carried out in separate devices of the control device implemented in the form of hardware and/or software. In this case, the apparatus comprises a control device equipped or communicating with corresponding devices. As indicated below, the apparatus may form part of an audio device or an audio system for a motor vehicle.

The invention furthermore relates to an audio device or an audio system for motor vehicle. The audio device may form part of a multimedia device on board a motor vehicle for outputting multimedia content, in particular audio and/or video content, to occupants of a motor vehicle. The audio device comprises at least one signal output device, i.e., for example, a loudspeaker device, which is configured for the acoustic output of conditioned audio signals into an internal space of a motor vehicle forming at least a part of a passenger compartment. The audio device is characterized in that, for conditioning audio signals subjected to lossy compression, it has at least one device as described for conditioning audio signals subjected to lossy compression.

All explanations relating to the described method apply accordingly to the apparatus for conditioning an audio signal subjected to lossy compression and to the audio device.

Example embodiments of the invention are explained in detail below with reference to the drawings. In the drawings.

Figure 3:
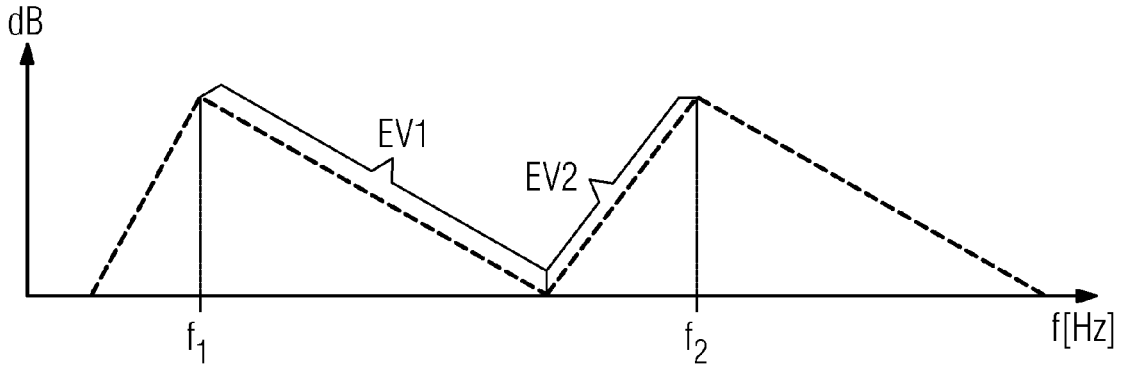

FIG. 3, 4 in each case show a schematic diagram of a psychoacoustic model according to one embodiment; and FIG. 5-8 in each case show a schematic diagram of a frequency spectrum in which energies of an audio signal are correlated with frequencies of the audio signal, according to one example embodiment.

Figure 1:
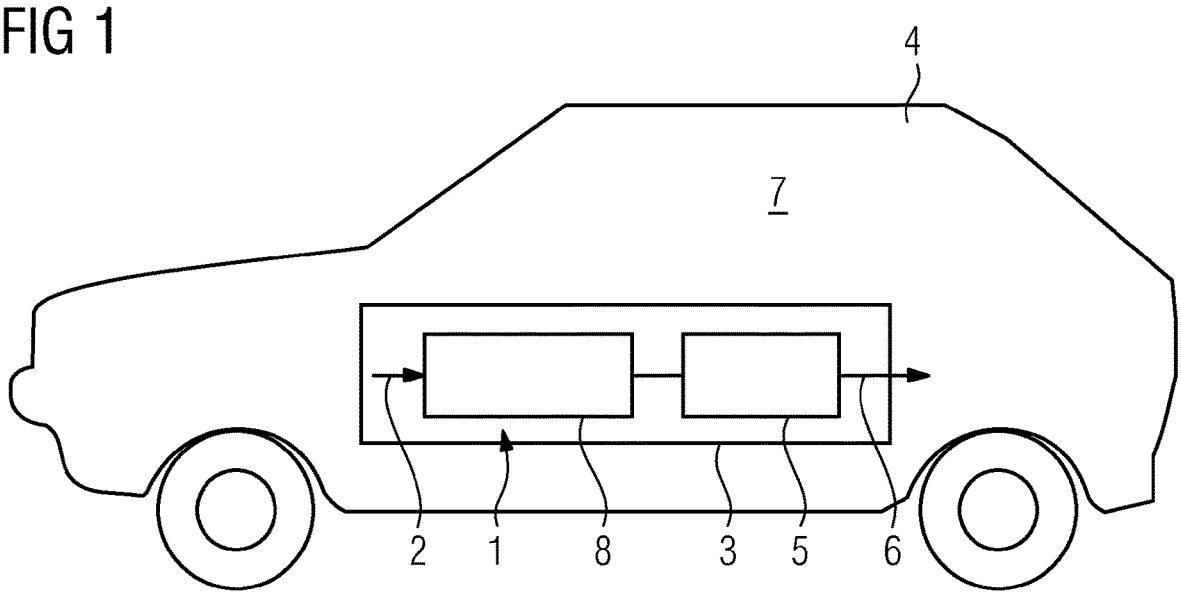
FIG. 1 shows a schematic diagram of an apparatus to carry out a method according to one example embodiment.

FIG. 1 shows a schematic diagram of an apparatus 1 for conditioning an audio signal 2 subjected to lossy compression. The audio signal 2 may, for example, be an audio file subjected to lossy compression. It may specifically be e.g. an MP3-coded audio file subjected to lossy compression by means of an MP3 algorithm ("MP3 file"). The audio file may already be at least partially decoded. The audio file may contain e.g. a piece of music.

The apparatus 1 shown in the example embodiment forms a part of an audio device 3 or of an audio system of a motor vehicle 4. The audio device 3 may form part of a multimedia device (not shown) on board a motor vehicle for outputting multimedia content, in particular audio and/or video content, to occupants of the motor vehicle 4. The audio device 3 comprises at least one signal output device 5 which is configured e.g. as a loudspeaker device or comprises at least one such device and is configured for the acoustic output of conditioned audio signals 6 into an inner space 7 of the motor vehicle 4 forming at least a part of the passenger compartment.

The apparatus 1 comprises a central control device 8 implemented in the form of hardware and/or software which is configured to implement a method, explained in detail below with reference to FIG. 2, for conditioning audio signals 2 subjected to lossy compression.

Individual, a plurality or all of the steps S1-S7 (S8) carried out according to the method explained below with reference to FIG. 2 can be carried out in devices (not shown) of the control device 8 implemented in the form of separate hardware and/or software. In this case, the apparatus 1 comprises a control device 8 equipped with corresponding devices.

Figure 2:
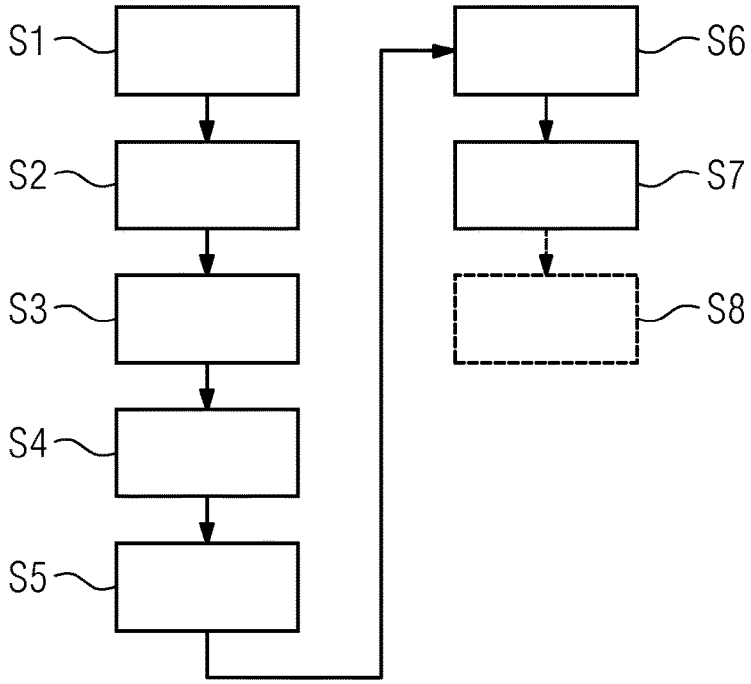
FIG. 2 shows a block diagram of a method according to one example embodiment.

FIG. 2 shows a block diagram of an example embodiment of a method for conditioning audio signals 2 subjected to lossy compression. The method can be carried out with the apparatus 1 described above.

In the first step S1 of the method, the audio signal 2 subjected to lossy compression which is to be conditioned is provided. The audio signal 2 can essentially be provided via any physical or non-physical audio source, i.e., for example, from the audio device 3. The audio signal 2 may specifically be provided e.g. from a data storage device (not shown) of the audio device 3.

In the second step S2 of the method, the audio signal 2 is transferred into a frequency spectrum. Energies of the audio signal 2 are correlated with frequencies of the audio signal 2 in the frequency spectrum. To do this, the content of the audio signal 2 is examined for its energy components, i.e. amplitude components and frequency components, and the individual energy components of the audio signal 2 are transferred in respect of their data by means of suitable algorithms, i.e., for example, by means of (fast) Fourier transform algorithms, into a frequency-dependent representation. A corresponding frequency spectrum is shown, inter alia, in a schematic diagram in FIG. 5.

In step S3 of the method, frequencies $f_i$ of local amplitude maxima are determined in the frequency spectrum; the frequency spectrum is therefore examined for local amplitude maxima and the frequencies $f_i$ associated with the respective amplitude maxima are determined. A local amplitude maximum graphically highlighted by a dot in FIG. 5-8 is understood to mean an amplitude maximum value in a defined frequency environment range.

In the fourth step S4 of the method, a first selection criterion is specified. The frequencies $f_i$ of two immediately successive (local) amplitude maxima, said frequencies meeting the first selection criterion, are preselected on the basis of the first selection criterion. In the fourth step S4, the frequencies $f_i$ of pairs of immediately successive amplitude maxima are examined in respect of the first selection criterion to determine whether the frequencies $f_i$ meet the first selection criterion. In the further steps S5-S7 of the method, only the frequencies $f_i$ meeting the first selection criterion are considered. A preselection of the frequencies $f_i$ considered below is therefore carried out in the fourth step S4.

The first selection criterion describes a specific limit frequency value $\Delta f_T$. Frequencies $f_i$ of immediately successive amplitude maxima meet the first selection criterion if the amount of their frequency difference $\Delta f_i$ exceeds the limit frequency value $\Delta f_T$ described by the first selection criterion, cf. the relationship represented by the formula set out below:

$$\Delta fi > |\Delta f_T|,$$

where $\Delta f_i$ is the frequency difference between two immediately successive amplitude maxima and $\Delta f_T$ is the limit frequency value.

The limit frequency value $\Delta f_T$ is specified by transferring the preselected frequencies $f_i$ into a Bark scale. The preselected frequencies $f_i$ are transferred into a Bark scale on the basis of the relationship represented by the formula set out below:

$$z = 13 \cdot \arctan(0.00076 \cdot f) + 3.5 \cdot \arctan\left(\frac{f}{7500}\right)^2,$$

where z is a Bark value and f is the frequency value to be transferred into the Bark scale.

Preselected frequencies $f_i$ and also the limit frequency values $\Delta f_T$ described by the first selection criterion can be transferred into the Bark scale via the relationship represented by the above formula.

The limit frequency value $\Delta f_T$ may correspond to a Bark value or a Bark value adjusted via an adjustment factor or multiplied by an adjustment factor. The adjustment factor is typically between 0.7 and 1.1, in particular 0.9 Bark. The limit frequency value thus typically corresponds to 0.7 to 1.1, in particular 0.9 Bark.

A second selection criterion is defined in the fifth step S5 of the method. Frequencies $f_i$ which are preselected (on the basis of the first selection criterion) and which (additionally) meet the second selection criterion are selected on the basis of the second selection criterion. In the fifth step S5, preselected frequencies $f_i$ are therefore examined to determine whether they (additionally) meet the second selection criterion. The frequencies $f_i$ (additionally) meeting the second selection criterion can again be transferred into a Bark scale.

The second selection criterion may describe a limit energy value. Respective preselected frequencies $f_i$ meet the second criterion if the amount of the energy content between them falls below this limit energy value described by the second selection criterion.

The limit energy value may be defined by a specified limit energy content T. Respective preselected frequencies $f_i$ meet the second selection criterion if their amount falls below the limit energy content T described by the second selection criterion, cf. the relationship represented by the formula set out below:

$$\int_{f1}^{f2} |S(f)|^2 \, df < T,$$

where S(f) is the area (energy content between the frequencies or frequency values $f_1$, $f_2$ of the two immediately successive amplitude maxima) described by the frequencies $f_1$, $f_2$, of the two immediately successive amplitude maxima, and T is the limit energy content.

Figure 5:
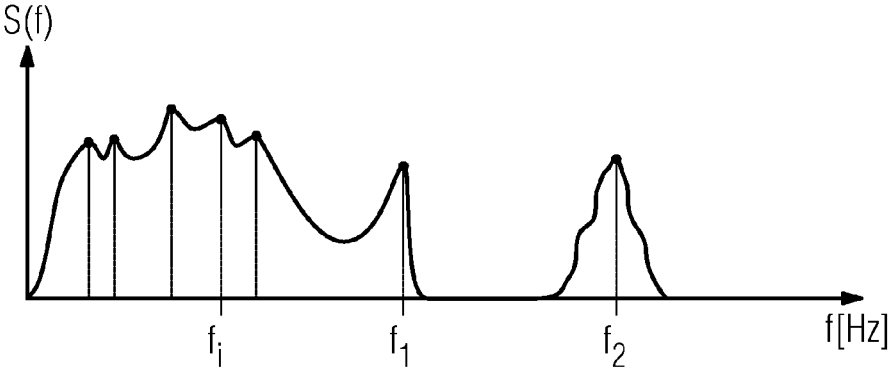
Figure 6:
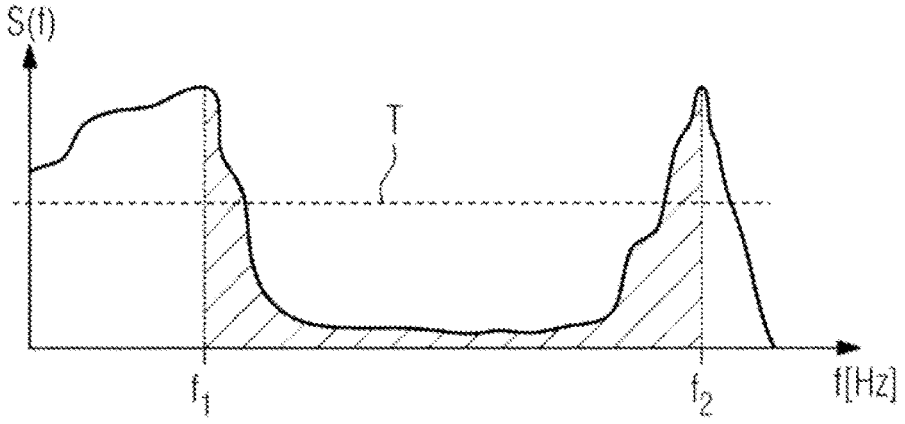

Reference is made in this connection to the schematic diagram shown in FIG. 6 of a frequency spectrum containing two preselected frequencies $f_1$, $f_2$, said frequency spectrum also comprising a section of a further frequency spectrum, i.e. the frequency spectrum shown in FIG. 5. FIG. 6 illustrates the (shaded) area described by the frequencies $f_1$, $f_2$ of the two immediately successive amplitude maxima and the limit energy content T shown by a horizontal line. The shaded area corresponds to the integral represented by the formula above.

The limit energy value can alternatively also be determined by producing a first energy characteristic EV1 originating from the preselected frequency $f_1$ ("lower frequency") which is associated with the lower (lower-frequency) amplitude maximum and a second energy characteristic EV2 originating from the preselected frequency $f_2$ ("upper frequency") which is associated with the upper (higher-frequency) amplitude maximum, and the two energy characteristics EV1, EV2 are transferred into the frequency spectrum. The limit energy value is then defined by the respective energy characteristics EV1, EV2.

Figure 7:
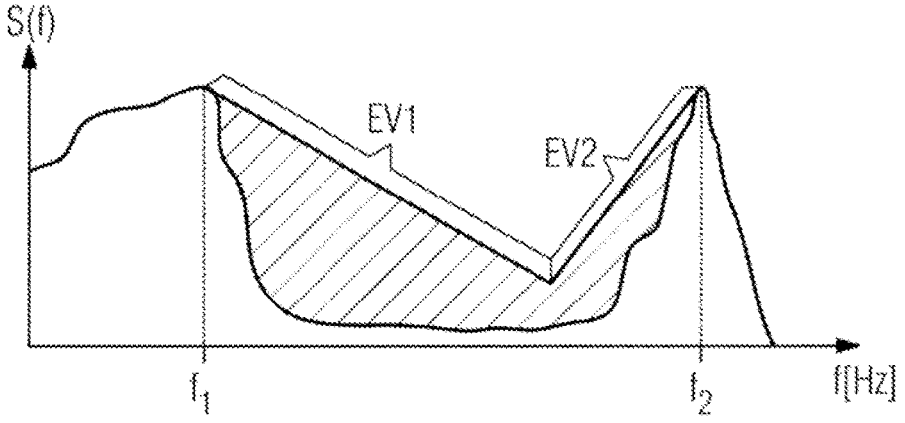

FIG. 7 shows that the produced energy characteristics EV1, EV2 are transferred in respect of their data into the frequency spectrum. The first energy characteristic EV1 passes originally from the lower frequency $f_1$ in the direction of the upper frequency $f_2$. The second energy characteristic EV2 passes originally from the upper frequency $f_2$ in the direction of the lower frequency $f_1$.

An enclosed range or an enclosed area is defined by the actual frequency characteristic between the frequencies $f_{1,2}$ and the energy characteristics EV1, EV2. The range is defined in terms of frequency components by the two frequencies $f_{1,2}$ and in terms of energy components by the actual frequency characteristic and the energy characteristics EV1, EV2 passing between them. The range typically contains only energy values≥zero. If the range is considered geometrically in relation to the frequency spectrum, the range corresponds to the area geometrically defined by the frequencies $f_{1,2}$ of the two immediately adjacent amplitude maxima, the energy characteristics and frequency characteristics passing between said amplitude maxima and the frequency axis (x-axis), shown as shaded in FIG. 7.

The energy characteristics EV1, EV2 are generated on the basis of a psychoacoustic model. A preferentially used psychoacoustic model is the spectral occlusion or masking model. FIG. 3 shows that the energy characteristics EV1, EV2 are derived from the hearing thresholds of the human ear provided by the respective psychoacoustic model at the respective preselected frequencies $f_{1,2}$. This means that the psychoacoustic model used is applied in each case to the two frequencies $f_{1,2}$. The first energy characteristic EV1 corresponds to the part of the hearing threshold derived from the psychoacoustic model for the lower frequency $f_1$, said part extending in the direction of increasing frequencies (cf. left curly bracket in FIG. 3). The second energy characteristic EV2 corresponds to the part of the hearing threshold derived from the psychoacoustic model for the upper frequency $f_2$, said part extending in the direction of decreasing frequencies (cf. right curly bracket in FIG. 3). In contrast to the representation in FIG. 3, it is obviously also possible for the energy characteristics EV1, EV2 to cross or intersect one another in a value range above the x-axis.

It is fundamental to the method that frequency ranges between the respective frequencies $f_i$ or $f_{1,2}$ of the two immediately successive amplitude maxima are conditioned, said frequencies meeting both the first and the second selection criterion. The steps S1-S5 of the method described thus far therefore relate to the determination of frequency ranges to be conditioned according to the method within the audio signal 2 to be conditioned.

In a sixth step S6 of the method, an audio filler signal AFS is produced or generated by means of a suitable signal generator. The audio filler signal AFS is produced in a targeted manner in relation to the previously determined frequency ranges to be conditioned within the audio signal 2 to be conditioned. The audio filler signal AFS is therefore produced in respect of the frequency range defined by the frequencies $f_i$ or $f_{1,2}$ of the two immediately successive amplitude maxima, said frequencies meeting both the first and the second selection criterion, in order to fill said frequency range and fill the "energy valley" present between the frequencies $f_i$. The produced audio filler signal AFS therefore has a frequency range lying between the frequencies $f_i$ of respective immediately successive amplitude maxima.

The audio filler signal AFS can be produced depending on or independently from acoustic parameters of the audio signal 2, in particular relating to respective energy components and frequency components of the audio signal 2. In the described example embodiment, the audio filler signal AFS is produced independently from acoustic parameters of the audio signal 2, i.e. purely in terms of the filling of the range defined in terms of frequency components by the frequencies $f_{1,2}$ and in terms of energy components by the actual frequency characteristic and the energy characteristics EV3, EV4 passing between them.

In a seventh step S7 of the method, the actual conditioning of the audio signal 2 is carried out by bringing the audio filler signal AFS into respective frequency ranges between respective frequencies $f_i$ meeting the first and second selection criterion so that a respective frequency range is filled with the audio filler signal AFS.

Prior to the conditioning of the audio signal 2 through incorporation of the audio filler signal AFS, a further or third energy characteristic EV3 originating from the selected lower frequency $f_1$ which is associated with the lower (lower-frequency) amplitude maximum, and a further or fourth energy characteristic EV4 originating from the selected upper (higher) frequency $f_2$ which is associated with the upper (high-frequency) amplitude maximum are generated.

Figure 8:
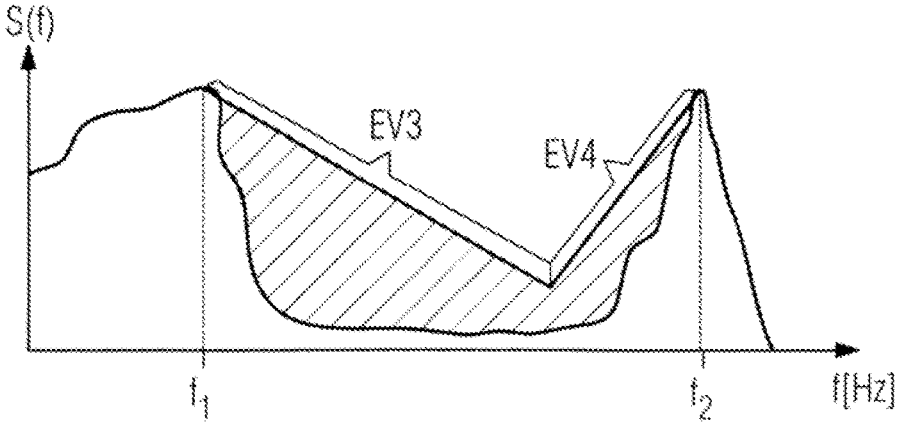
Figure 9:
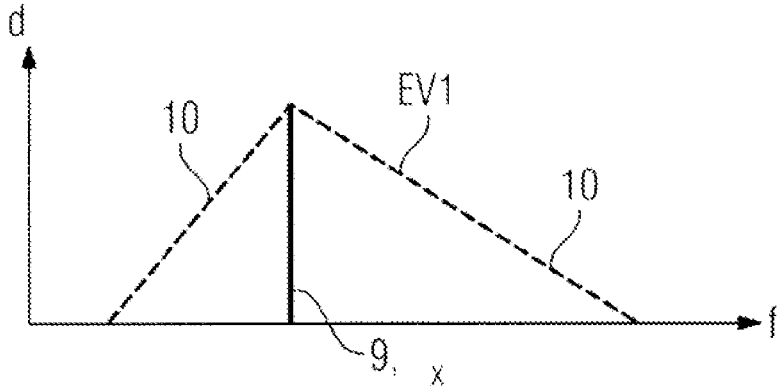
Figure 10:
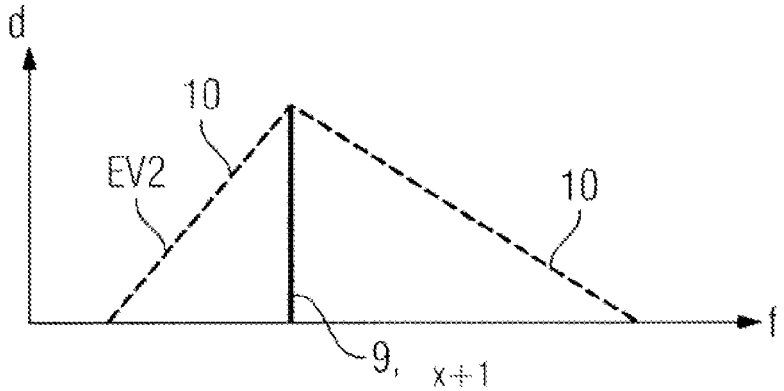
Figure 11:
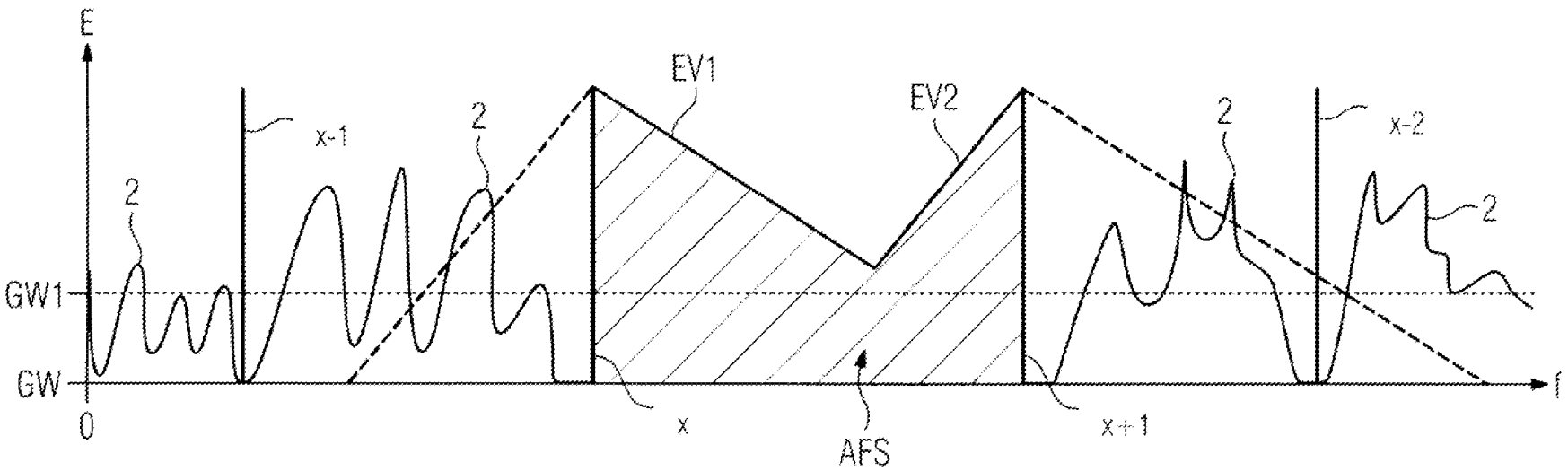

FIG. 8 shows that the produced energy characteristics EV3, EV4 are transferred in respect of their data into the frequency spectrum in the same way as the energy characteristics EV1, EV2. The third energy characteristic EV3 passes originally from the lower frequency $f_1$ in the direction of the upper frequency $f_2$. The fourth energy characteristic EV4 passes originally from the upper frequency $f_2$ in the direction of the lower frequency $f_1$.

An enclosed range or an enclosed area is defined by the actual frequency characteristic between the frequencies $f_{1,2}$ and the energy characteristics EV3, EV4. The range is defined in terms of frequency components by the frequencies $f_{1,2}$ of the amplitude maxima and in terms of energy components by the actual frequency characteristic and the energy characteristics EV3, EV4 passing between them. The range typically contains only energy values≥zero. If the range is considered geometrically in relation to the frequency spectrum, the range corresponds to the area geometrically defined by the frequencies $f_{1,2}$ of the two immediately adjacent amplitude maxima, the energy characteristics and frequency characteristics passing between them and the frequency axis (x-axis), shown as shaded in FIG. 8.

Figure 4:
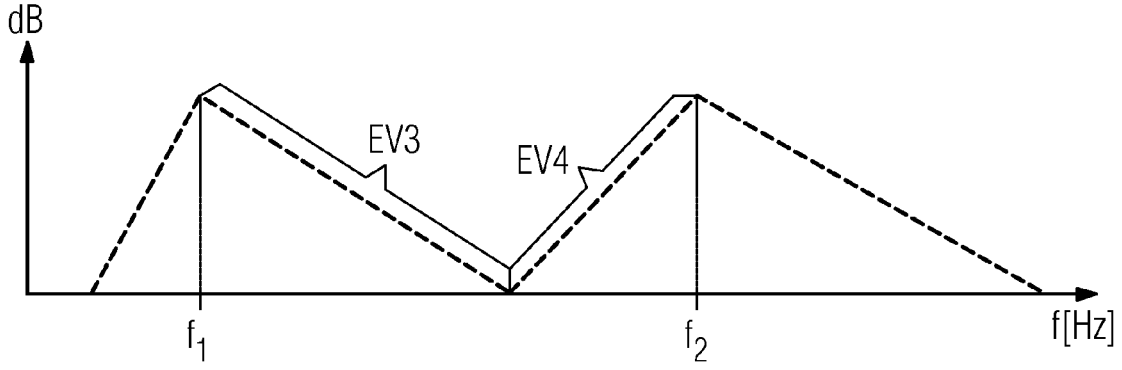

The energy characteristics EV3, EV4 are similarly generated on the basis of a psychoacoustic model. Here also, a preferentially used psychoacoustic model is the spectral occlusion or masking model (cf. FIG. 4). FIG. 4 shows that the energy characteristics EV3, EV4 are derived from the hearing thresholds of the human ear provided by the respective psychoacoustic model at respective preselected frequencies $f_{1,2}$. Here also, this means that the psychoacoustic model used is applied in each case to the two immediately successive frequencies $f_{1,2}$. The third energy characteristic EV3 corresponds to the part of the hearing threshold derived from the psychoacoustic model for the lower frequency $f_1$, said part extending in the direction of increasing frequencies (cf. left curly bracket in FIG. 4). The fourth energy characteristic EV4 corresponds to the part of the hearing threshold derived from the psychoacoustic model for the upper frequency $f_2$, said part extending in the direction of decreasing frequencies (cf. right curly bracket in FIG. 4). In contrast to the representation in FIG. 4, it is obviously possible here also for the energy characteristics EV3, EV4 to cross or intersect one another in a value range above the x-axis.

The (first two) energy characteristics EV1, EV2 may generally differ from the third and fourth energy characteristics EV3, EV4.

On the whole, "energy valleys" resulting from the data compression of the audio signal 2 are therefore determined according to the method and are filled in a targeted manner with a specific data content in the form of the audio filler signal AFS produced with regard to the determined "energy valleys", whereby a conditioning of the audio signal 2 is implemented. As a result, the conditioning of the audio signal 2 according to the method is implemented, in particular, by an at least partial replacement of missing frequency components of the audio signal 2, i.e., for example, frequency components discarded during the data compression.

An optional eighth step S8 of the method can provide an output of a conditioned audio signal 2 via at least one signal output device 5 and/or a storage of the conditioned audio signal 2 in at least one storage device (not shown) and/or a transmission of a conditioned audio signal 2 to at least one communication partner (not shown). The conditioned audio signal 2 can be subjected to an inverse Fourier transform before the output and/or storage and/or transmission.

A method for conditioning an audio signal 2 subjected to lossy compression is provided by the described steps S1-S7 (S8) of the method, said method being improved particularly in terms of the efficiency of the conditioning and the quality of the conditioned audio signal 6.

REFERENCE NUMBER LIST

1 Apparatus
2 Audio signal (compressed)
3 Audio device
4 Motor vehicle
5 Signal output device
6 Audio signal (conditioned)
7 Internal space
8 Control device
AFS Audio filler signal
EV1-EV4 Energy characteristic
$f_i$ Frequency
$\Delta f_T$ Limit frequency value
T Limit energy content
S1-S8 Method step

The invention claimed is:

1. A method for conditioning an audio signal (2) subjected to lossy compression, characterized by the following steps:

providing an audio signal (2) subjected to lossy compression which involves an already decoded audio file subjected to lossy compression, transferring the audio signal (2) into a frequency spectrum in which energies of the audio signal (2) are correlated with frequencies of the audio signal (2), determining the frequencies ($f_i$) of local amplitude maxima in the frequency spectrum, specifying a first selection criterion and preselecting the frequencies ($f_i$) of two immediately successive local amplitude maxima, said frequencies meeting the first selection criterion, specifying a second selection criterion and selecting preselected frequencies ($f_i$) of two immediately successive amplitude maxima, said frequencies meeting the first selection criterion and additionally meeting the second selection criterion, producing an audio filler signal (AFS), and conditioning the audio signal (2) by bringing the audio filler signal (AFS) into a frequency range between the frequencies ($f_i$) meeting the second selection criterion, so that the range is filled at least in sections, in particular completely, with the audio filler signal (AFS).

2. The method as claimed in claim 1, characterized in that the frequencies ($f_i$) meet the first selection criterion if the amount of their frequency difference falls below a limit frequency value ($\Delta f_i$).

3. The method as claimed in claim 2, characterized in that the limit frequency value ($\Delta f_i$) is specified through transfer of the frequencies ($f_i$) into a Bark scale, wherein the limit frequency value ($\Delta f_i$) corresponds to a Bark value or a Bark value adjusted via an adjustment factor.

4. The method as claimed in claim 3, characterized in that the adjustment factor used corresponds to a value between 0.7 and 1.1 Bark, in particular 0.9 Bark.

5. The method as claimed in claim 1, characterized in that the frequencies ($f_i$) meet the second selection criterion if the amount of the energy content between the frequencies ($f_i$) falls below a limit energy value.

6. The method as claimed in claim 5, characterized in that the limit energy value is defined by a specified limit energy content (T).

7. The method as claimed in claim 5, characterized in that limit energy value is specified by producing a first energy characteristic (EV1) originating from the selected lower frequency ($f_1$) and a second energy characteristic (EV2) originating from the selected upper frequency ($f_2$) and by transferring the two energy characteristics (EV1, EV2) into the frequency spectrum, wherein the limit energy value is defined by the respective energy characteristics (EV1, EV2).

8. The method as claimed in claim 7, characterized in that the first and second energy characteristic (EV1, EV2) are produced on the basis of a psychoacoustic model.

9. The method as claimed in claim 1, characterized in that, prior to the conditioning of the audio signal (2) by transferring the audio filler signal (AFS) into the frequency range between the frequencies ($f_i$) meeting the second selection criterion so that the frequency range is filled at least in sections, in particular completely with the audio filler signal (AFS), a, where relevant, third energy characteristic (EV3) originating from the selected lower frequency ($f_1$) and a, where relevant, fourth energy characteristic (EV4) originating from the selected upper frequency ($f_2$) are produced, and the two energy characteristics (EV3, EV4) are transferred into the frequency spectrum.

10. The method as claimed in claim 9, characterized in that the audio filler signal (AFS) is brought at least in sections, in particular completely, into a range of the frequency spectrum defined by the two selected frequencies ($f_1$, $f_2$) and the respective energy characteristics (EV3, EV4).

11. The method as claimed in claim 9, characterized in that the energy characteristics (EV3, EV4) are produced on the basis of a psychoacoustic model.

12. The method as claimed in claim 1, characterized in that the audio filler signal (AFS) is produced depending on or independently from acoustic parameters of the audio signal (2).

13. The method as claimed in claim 12, characterized in that the audio filler signal (AFS) is produced depending on acoustic parameters of the audio signal (2), wherein the range (A) is filled depending on specific acoustic parameters of the audio signal (2) or a further audio signal to be conditioned (2).

14. An apparatus (1) for conditioning an audio signal (2) subjected to lossy compression according to a method according to claim 1, characterized by at least one control device (8) which is configured for providing an audio signal (2) subjected to lossy compression, transferring the audio signal (2) into a frequency spectrum in which energies of the audio signal (2) are correlated with frequencies of the audio signal (2), determining frequencies ($f_i$) of local amplitude maxima in the frequency spectrum, specifying a first selection criterion and preselecting the frequencies ($f_i$) of two immediately successive local amplitude maxima, said frequencies meeting the first selection criterion, specifying a second selection criterion and selecting preselected frequencies ($f_i$) of two immediately successive amplitude maxima, said frequencies meeting the first selection criterion and additionally meeting the second selection criterion, producing an audio filler signal (AFS), and conditioning the audio signal (2) by bringing the audio filler signal (AFS) into a range between the frequencies ($f_i$) meeting the second selection criterion, so that the range is filled at least in sections, in particular completely, with the audio filler signal (AFS).

15. An audio device (3) for a motor vehicle (4), comprising at least one signal output device (5) which is configured for the acoustic output of conditioned audio signals (6) into an internal space (7) of a motor vehicle (4) forming at least a part of a passenger compartment, characterized in that it has at least one apparatus (1) as claimed in claim 14 for conditioning audio signals (2) subjected to lossy compression.

* * * * *